US005822986A

United States Patent [19]

Higashide

[11] Patent Number: 5,822,986

[45] Date of Patent: Oct. 20, 1998

[54] EXHAUST SYSTEM FOR ENGINE

[75] Inventor: Shinji Higashide, Iwata, Japan

[73] Assignee: Yamaha Hatsudoki Kabushiki Kaisha, Iwata, Japan

[21] Appl. No.: 770,545

[22] Filed: Dec. 20, 1996

Related U.S. Application Data

[63] Continuation of Ser. No. 451,139, May 26, 1995.

[30] Foreign Application Priority Data

May 30, 1994 [JP] Japan ..... 6-139324

[51] Int. Cl.[6] ..... F01N 7/10

[52] U.S. Cl. ..... 60/313; 60/323

[58] Field of Search ..... 60/313, 323

[56] References Cited

U.S. PATENT DOCUMENTS

| | | | |
|---|---|---|---|
| 3,043,094 | 7/1962 | Nichols | 60/323 |
| 3,488,944 | 1/1970 | Saletzki | 60/605.1 |
| 4,050,245 | 9/1977 | Little et al. | 60/313 |
| 4,116,172 | 9/1978 | Lohr et al. | 60/313 |
| 4,656,830 | 4/1987 | Ohno | 60/276 |
| 4,884,399 | 12/1989 | Morris | 60/313 |
| 5,471,835 | 12/1995 | Friedman | 60/313 |

FOREIGN PATENT DOCUMENTS

| | | | |
|---|---|---|---|
| 634616 | 1/1962 | Canada | 60/313 |
| 312251 | 4/1989 | European Pat. Off. . | |
| 2640713 | 3/1978 | Germany . | |

*Primary Examiner*—Douglas Hart

*Attorney, Agent, or Firm*—Knobbe, Martens, Olson & Bear LLP

[57] ABSTRACT

An exhaust system for an engine having at least four exhaust ports firing in sequential order. The exhaust system includes an exhaust manifold having two collector sections which extend in substantial part in parallel side-by-side relationship to provide a compact construction. Each collector section is served by a pair of branch portions that communicate with respective cylinders where the cylinders collected firing at least 270 degrees from each other to minimize the effect of the exhaust pulses from one cylinder on the other cylinders.

6 Claims, 12 Drawing Sheets

EXHAUST SYSTEM FOR ENGINE

This application is a continuation of Ser. No. 08/457,139 filed May 26, 1996.

BACKGROUND OF THE INVENTION

This invention relates to an exhaust system for an engine and more particularly to an improved exhaust manifold arrangement for a multiple cylinder internal combustion engine.

In internal combustion engines, it is the normal practice to employ an exhaust system for conveying the exhaust gases from the combustion chambers of the engine and specifically from the exhaust ports thereof to the atmosphere. The length and shape of the exhaust system is, as has become well known, very important in determining the operation of the engine. By properly tuning the length and shape of the exhaust system as well as the way in which the exhaust gases from the individual chambers are collected, it is possible to vary the performance of the engine significantly. In many applications, however, it is not possible to obtain the desired exhaust effect because of spatial and other constraints.

In many engine applications, and particularly those in the automotive field, the exhaust manifolds serve the engine and have flange portions there attached to the surface of the engine through which the exhaust ports extend. This is normally the cylinder head in an overhead engine. From this flange there are individual runners that are then joined in a collector section which, in turn, discharges into one or more exhaust pipes through mufflers, catalytic converters or other exhaust treatment devices. In order to provide the desired exhaust tuning effect and to either minimize or control the effect of the exhaust pulses from one cylinder on others, the collector sections frequently serve exhaust ports that are not necessarily adjacent to each other. In order to provide some length for the exhaust system before the exhaust runners are joined, frequently the exhaust system becomes quite twisted and complicated.

FIGS. 1 and 2 show a conventional type of exhaust system which may be employed either for an in-line four cylinder engine or for one bank of an eight cylinder engine having its cylinder banks disposed at angles to each other. As may be seen, each exhaust manifold is comprised of a flange 21 that is adapted to be affixed to the side of the cylinder head and which has individual openings 22, 23, 24 and 25 that mate with corresponding exhaust ports of the engine and specifically the discharge ends thereof which terminate in an outer surface of the cylinder head (not shown). For ease of understanding, the cylinders served by the respective exhaust ports are numbered 1 through 4 beginning at the left hand side of the engine. The engine illustrated is of a type in which the cylinders do not fire in the order 1-2-3-4 as this is not necessarily a common firing order employed with either four cylinder engines or the cylinder banks of a V8 engine.

Because of this firing order and for other tuning reasons, there are provided individual exhaust runners 26, 27, 28 and 29, each of which extends from a respective one of the flange exhaust port openings 22 through 25. These exhaust runners 26, 27, 28 and 29 are collected into a pair of Y-shape collector sections 31 and 32. The collector sections 31 and 32 have a common flange 33 that is adapted to be connected either directly or indirectly to an exhaust pipe (not shown) in the remaining components of the exhaust system.

It may be seen that the pipes 27 and 28 extending from cylinders 2 and 3 are collected in the Y pipe collector 31 while the pipes 26 and 29 from cylinders 1 and 4 are collected in the Y collector pipe 32. As may be seen, this requires pipes that have considerably different lengths and which cross over and bend around each other. In fact, it is common to refer to this type of exhaust system as a "spaghetti system".

In addition to being unsightly and providing a complicated configuration, this type of exhaust system is quite expensive to manufacture. Furthermore, because of its configuration, the spatial requirements in a motor vehicle become quite large and this is obviously undesirable.

It is, therefore, a principal object of this invention to provide an improved, simplified and compact exhaust manifold for an internal combustion engine.

It is another object of this invention to provide an improved, compact, easily manufactured and still highly effective exhaust manifold for an engine.

It is a further object of this invention to provide an exhaust manifold for a multiple cylinder engine wherein the manifold is neat, compact and in which the collector sections extend generally parallel to each other to provide a neat and compact arrangement that can be easily manufactured.

SUMMARY OF THE INVENTION

This invention is adapted to be embodied in an exhaust manifold for an internal combustion engine having an outer surface through which at least four exhaust ports discharge. The exhaust manifold is comprised of at least two collector sections, each having a collector pipe section connected by at least two branch sections to a respective of the exhaust port discharges. The collector sections extend at least in substantial part in parallel relationship to each other.

DETAILED DESCRIPTION OF THE PREFERRED EMBODIMENTS OF THE INVENTION

Figure 1:
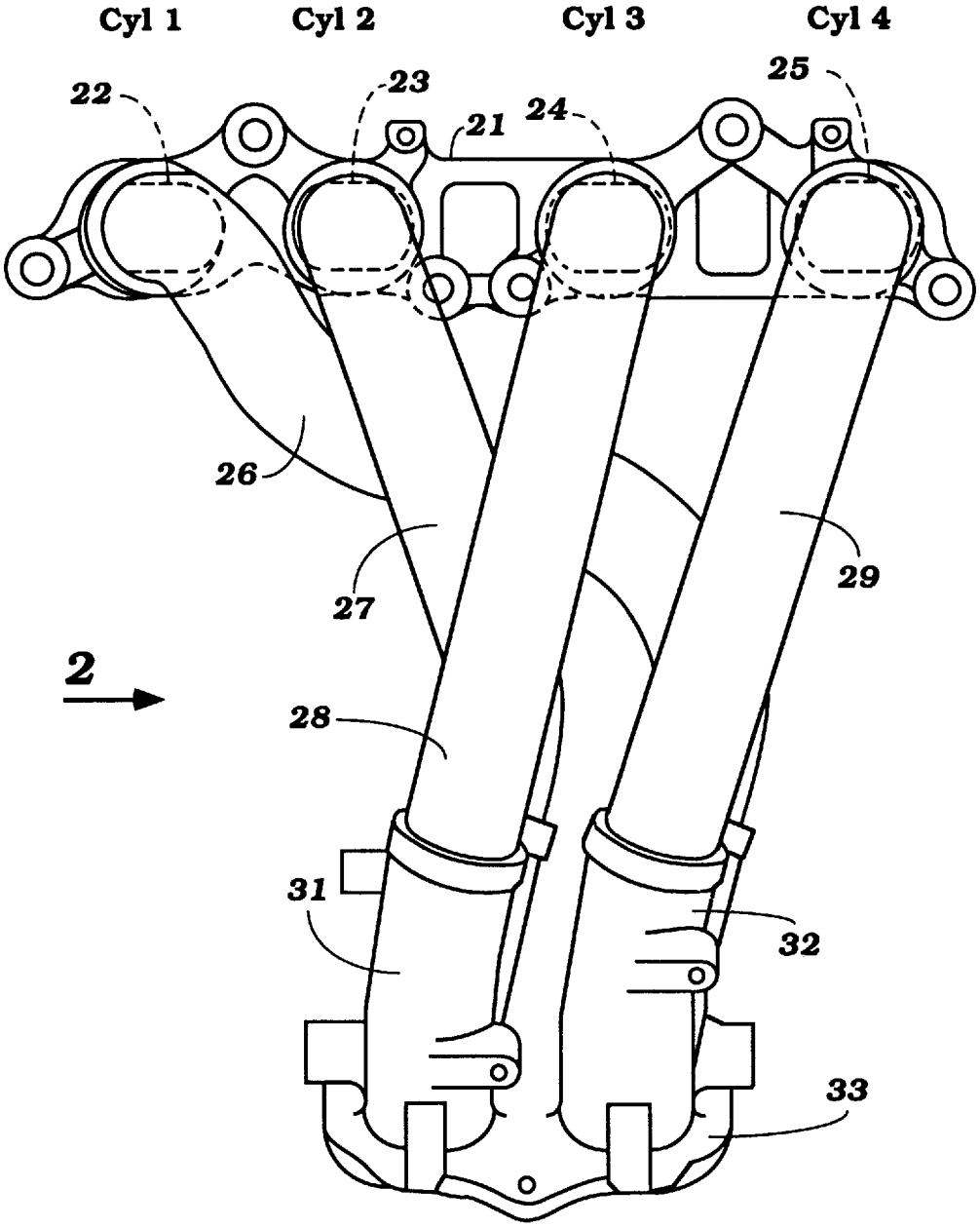
Figure 1 Prior Art
FIG. 1 is a side elevational view of a conventional prior art type of exhaust manifold.
Figure 2:
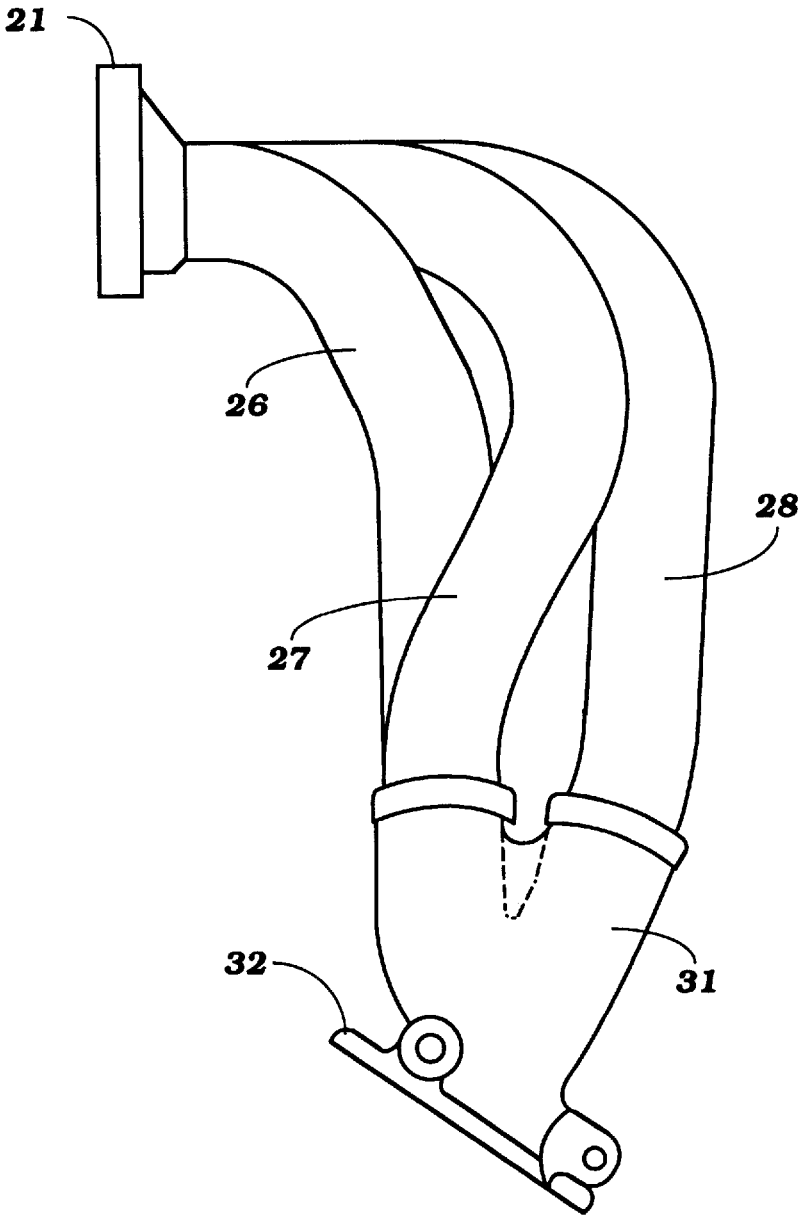
Figure 2 Prior Art
FIG. 2 is an end elevational view of the prior art type of exhaust manifold looking in the direction of the arrow 2 in FIG. 1.
Figure 3:
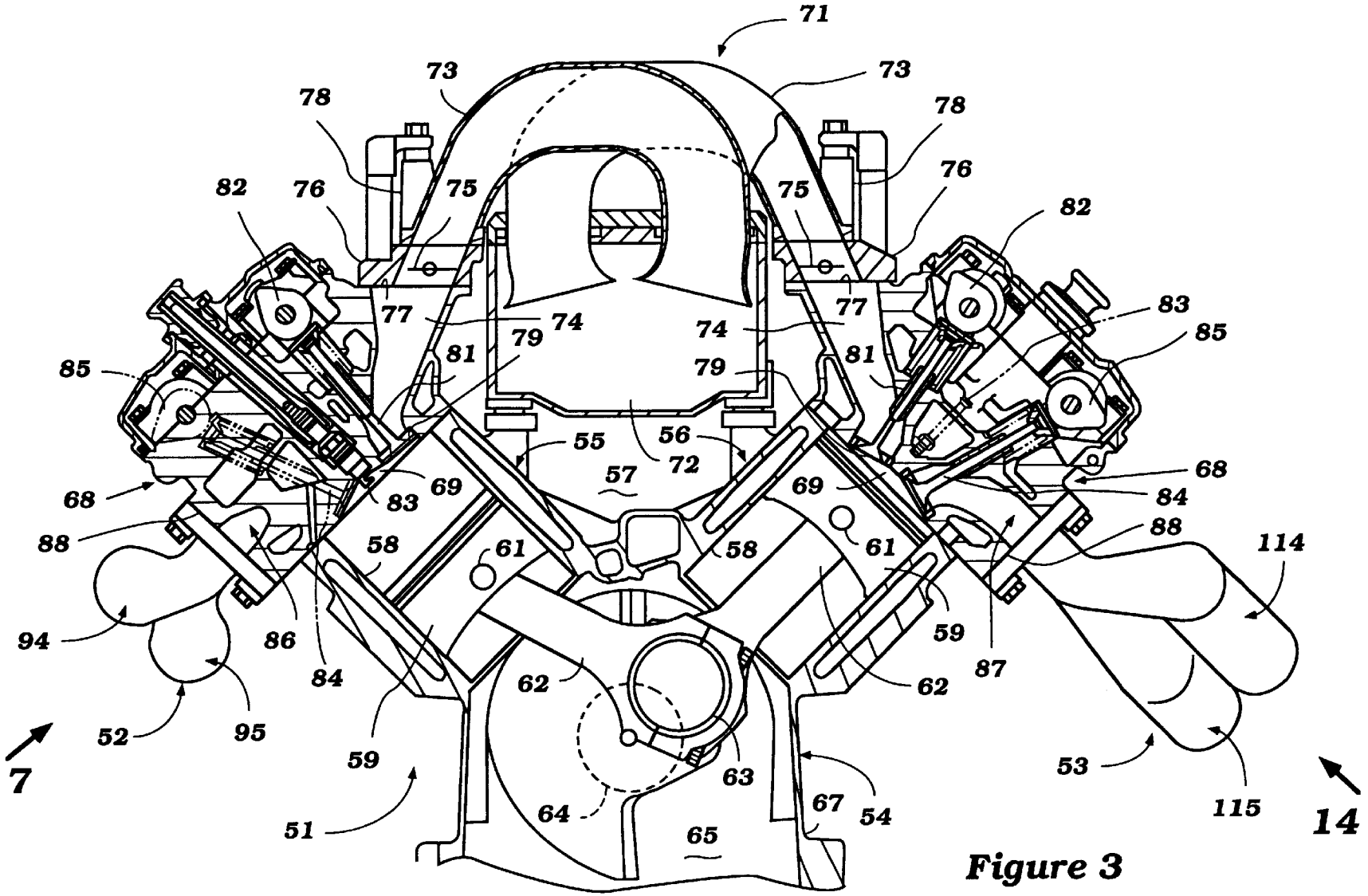
FIG. 3 is a partial cross-sectional view taken through an internal combustion engine having an exhaust manifold constructed in accordance with an embodiment of the invention.

Referring now in detail initially to FIG. 3, a V8 four stroke internal combustion engine constructed in accordance with an embodiment of the invention is shown partially and in cross section and identified generally by the reference numeral 51. The invention deals primarily with the exhaust manifolds 52 and 53 that collect exhaust gases from the cylinders of the banks of the engine and discharge them to the remainder of the exhaust system.

For that reason, the details of the internal structure of the engine 51 are not truly necessary to permit those skilled in the art to understand and practice the invention. However, for the sake of orientation, some of the engine components will be described. Where any engine component is not illustrated or described, reference may be had to the copending application entitled "Control Valve For Engine Intake Control System", Ser. No. 08/378,532, filed Jan. 24, 1995 in the name of Masahiro Uchida and assigned to the assignee hereof.

That disclosure is incorporated herein by reference but it is to be understood and those skilled in the art will appreciate how the invention can be practiced with engines having other internal constructions. In addition, although the invention is described in conjunction with a V8 engine, it should be readily apparent to those skilled in the art how the invention can be applied to either an in-line four cylinder engine or engines having other numbers of cylinders and other configurations so long as those engines have at least four in-line cylinders.

The engine 51 includes a cylinder block, indicated generally by the reference numeral 54 which is provide with a pair of cylinder banks 55 and 56 that are disposed at a 90 degree angle to each other and which define a valley 57 therebetween. Again, although the invention is described in conjunction with a 90 degree V, it will be apparent to those skilled in the art how the invention can be practiced with V-type engines having other angles between their cylinder banks including opposed engines.

Figure 5:
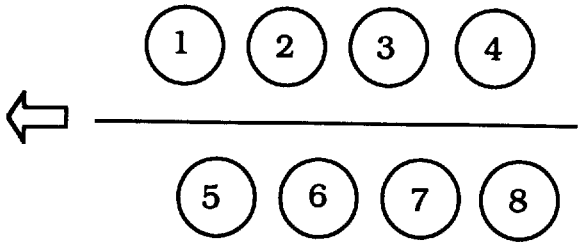
FIG. 5 is a schematic top plan view showing the cylinder order and numbering pattern.

Each cylinder bank 55 and 56 is provided with four aligned cylinder bores 58. As is typical with V-type engine practice, the cylinder banks 55 and 56 are staggered relative to each other as shown in FIG. 5 for a reason which is well known in this art and which will be described later.

Pistons 59 reciprocate in the cylinder bores 58. These pistons 59 are connected by means of piston pins 61 to the upper or small ends of connecting rods 62. The lower ends of the connecting rods 62 are journaled on respective throws 63 of a crankshaft 64. The off-setting or staggering of the cylinder bores 58 of the cylinder banks 55 and 56 permits the connecting rods 62 to be journaled on common throws of the crankshaft 64 as shown in FIG. 4.

Figure 4:
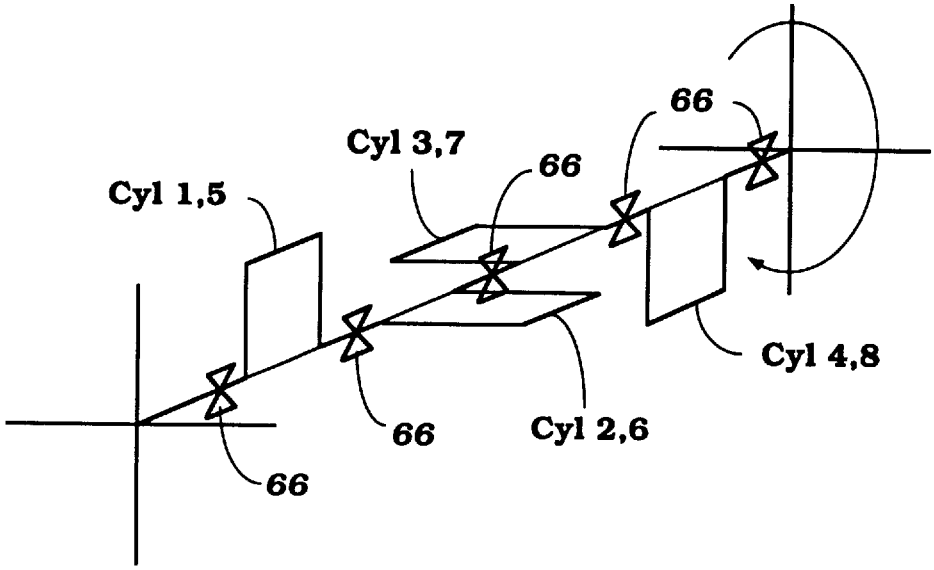
FIG. 4 is a partially schematic view showing the crankshaft of the engine and the direction of crankshaft rotation.

The crankshaft 64 is journaled within a crankcase chamber 65 by main bearings shown schematically in FIG. 4 and indicated by the reference numerals 66. The crankcase chamber 65 is closed by a crankcase member (not shown) that is affixed to the skirt 67 of the cylinder block 54 in a well-known manner.

A cylinder head 68 is affixed to each cylinder bank 55 and 56 of the cylinder block 54 in any suitable manner. Each cylinder head 68 has four recesses 69 which are in confronting relationship with the cylinder bores 58 and form with them in the heads of the pistons 59, the combustion chambers of the engine 51.

An intake charge is delivered to these combustion chambers by means of an induction system, indicated generally by the reference numeral 71 and which may be of any known type. In the illustrated embodiment, this induction system 71 includes a plenum chamber 72 that is positioned in the valley 57 and which draws atmospheric air through a suitable air inlet device. A plurality of manifold runner sections 73 extend from the plenum chamber 72 to intake passages 74 formed in the cylinder heads 68 on the valley side thereof.

As described in the aforenoted copending application, the induction system 71 may be tuned so as to provide long, low speed flow paths and short high speed flow paths. Control valves 75 are provided in valve bodies 76 disposed between the manifold runners 73 and surfaces 77 of the cylinder head 68 through which the intake passages 74 extend. Fuel injectors 78 are mounted in these valve bodies 76 and spray fuel into the intake passages 74 in a controlled manner.

The cylinder head intake passages 74 terminate at valve seats 79 formed in the cylinder head recesses 69. The valve seat 79 are disposed in any desirable manner and the aforenoted copending application discloses a three intake valve per cylinder arrangement that may be utilized in conjunction with the invention. However, the application for the invention is not so limited.

Intake valves 81 are slidably supported in the cylinder heads 68 and have their head portions in cooperating relationship with the valve seat 79 so as to control the flow therethrough. The opening and closing of the intake valves 81 is controlled by a respective intake camshaft 82 that is journaled in the respective cylinder head 68 in a known manner. The camshafts 82 are driven by a suitable cam drive mechanism from the crankshaft 64 at one-half crankshaft speed.

Figure 6:
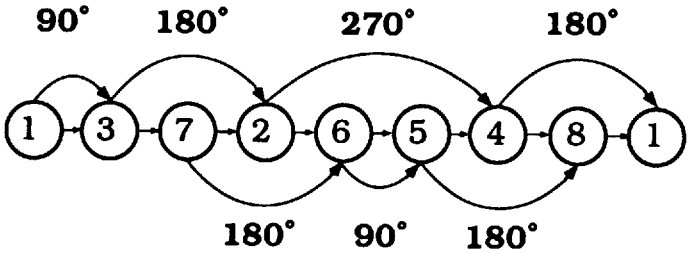
FIG. 6 is a timing diagram showing the firing order of the cylinders.

The charge which is admitted to the combustion chambers through the induction system 71 and by the fuel injector 78 is fired by one or more spark plugs 83 that are mounted in the cylinder heads 68 with their spark gaps disposed generally centrally in each combustion chamber recesses 69. These spark plugs are fired by a suitable ignition system and, in accordance with the invention, the firing order for these cylinders is on even intervals and in the order 1-3-7-2-6-5-4-8 as shown in FIG. 6 with the cylinders being numbered as shown in FIG. 5.

The firing of the charge causes it to burn and expand and drive the pistons 59 downwardly to rotate the crankshaft 64 in a well known manner. At some time approaching bottom dead center or slightly thereafter, exhaust valves 84 which are slidably supported in the cylinder head 68 on the side opposite the intake valves 81 in a known manner are opened by respective exhaust camshafts 85. The exhaust valves 84 control the flow through exhaust ports formed in the combustion chamber 69 to exhaust passages 86 and 87 formed in the cylinder heads 68 of the right and left cylinder banks receptively. Like the intake camshafts 82, the exhaust camshafts 85 are driven at one-half crankshaft speed by any suitable cam-driving mechanism. As described in the aforenoted copending application, there may be two exhaust valves 84 per cylinder although, as previously noted, the invention may be utilized in conjunction with a variety of types of exhaust valve and porting arrangement.

The exhaust passages 86 and 87 of the respective cylinder head 68 extend through exhaust side surfaces 88 of the respective cylinder heads 68 and which are disposed outwardly of the V angle.

Referring now to FIGS. 7 through 13, the first or right hand side exhaust manifold 52 will be described in detail. It will be seen that the exhaust ports 86 of each of the cylinders, which are indicated by suffixes 1, 2, 3 and 4 to denote between the individual cylinders have their axes lying on a common plane which is indicated by the reference line 89, this lying on the cylinder head surface 88. The exhaust manifold 52 is comprised of an manifold flange indicated generally by the reference numeral 91 and which has, as clearly shown in FIG. 13, individual openings 92-1, 92-2, 92-3, and 92-4 which mate with the cylinder head exhaust port openings 86-1, 86-2, 86-3, and 86-4. The flange 91 has a plurality of openings 93 that receive threaded fasteners (not shown) for affixing the exhaust manifold 52 to the cylinder head 68 in a well known manner. It should be noted that the fastener receiving openings 93 are paired and are on diagonally opposite sides of the flange openings 92.

The exhaust manifold 52 further includes a pair of collector sections, indicated by the reference numeral 94 and 95, respectively. As may be clearly seen in FIGS. 7–12, the collector sections 94 and 95 have common portions 96 and 97, respectively, that extend in substantially parallel side-by-side relationship along a substantial portion of their length.

The collector section 94, in addition to the straight common section 96, has a pair of branch sections 98 and 99 which connect the common section 96 to the cylinder ports 92-1 and 92-2 of the flange 91 which communicate with the exhaust port openings 86-1 and 86-2 of the No. 1 and No. 2 cylinders of the right-hand bank. The branch sections 98 and 99 join the straight common section 96 at an acute angle to provide an oval shape at their juncture to provide a large effective area.

Figure 11:
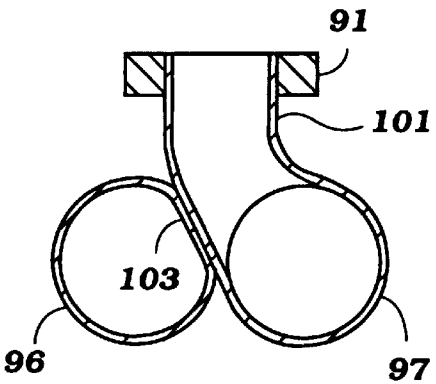
Figure 12:
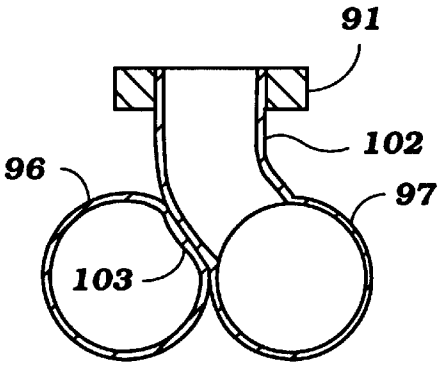
Figure 13:
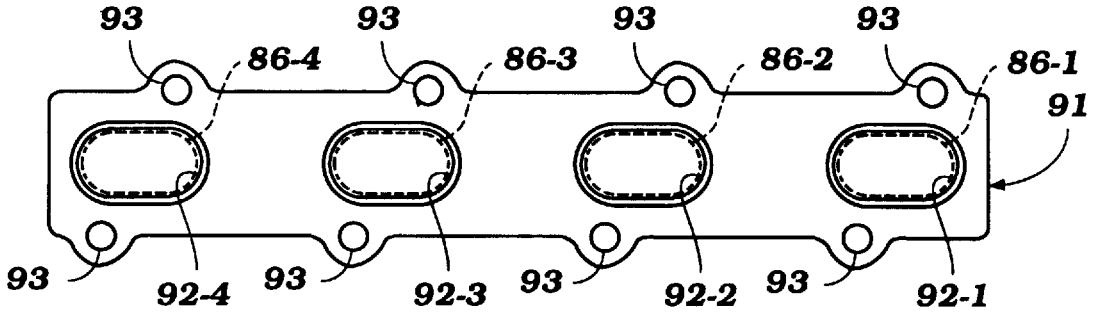
FIG. 13 is an elevational view of the flange face of the right hand exhaust manifold and is taken in the direction of the arrow 13 in FIG. 8.
Figure 14:
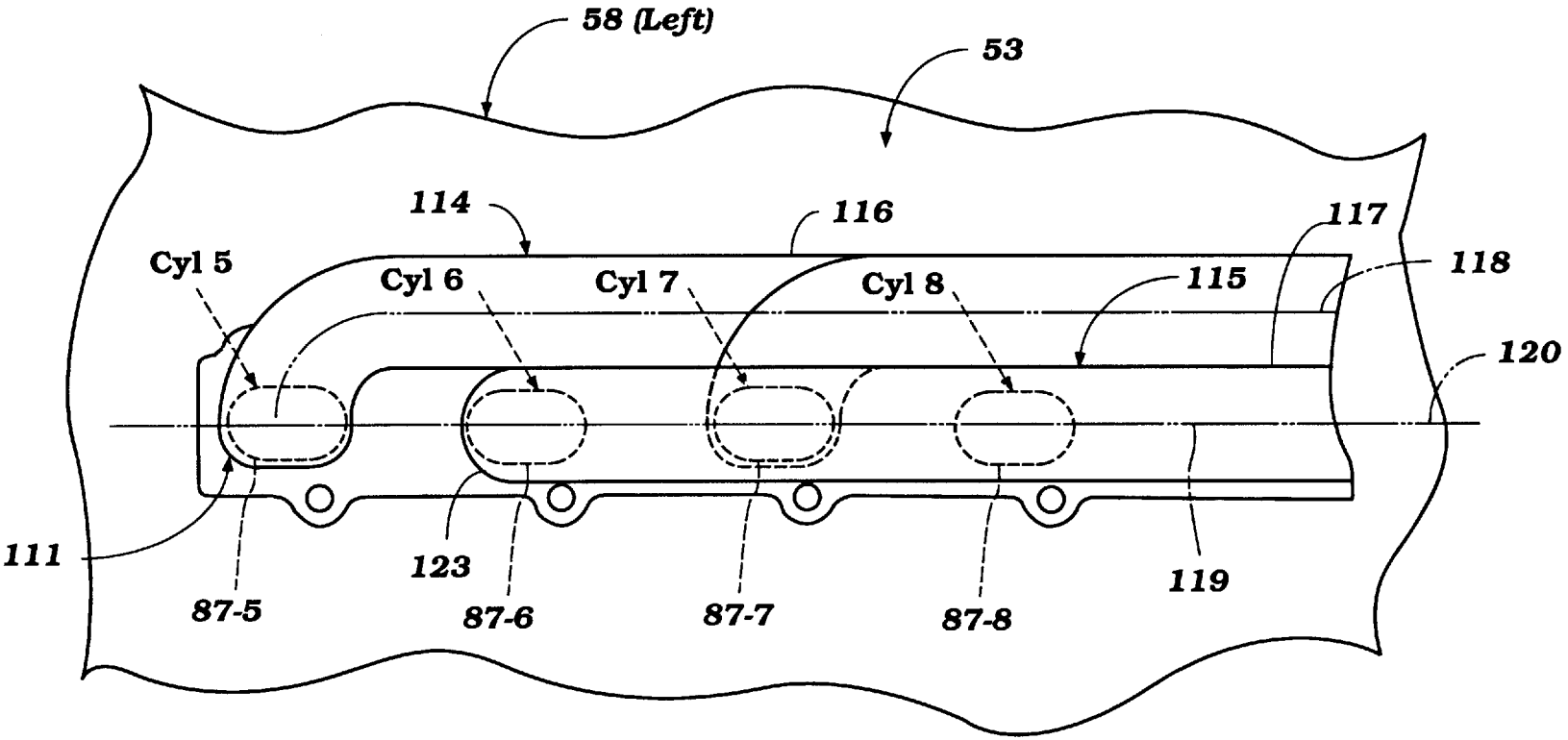
FIG. 14 is an enlarged side elevational view of the left bank exhaust manifold and is taken generally in the direction of the arrow 14 in FIG. 3.

In a similar manner, the straight section 97 of the collector portion 95, is served by a pair of runner sections 101 and 102 that extend to the flange openings 92-3 and 92-4 that communicate with the exhaust port openings 86-3 and 86-4 of No. 3 and No. 4 cylinders. Again this connection is at an acute angle to provide a large area, oval shaped juncture. In order to provide a compact construction, the common section 96 of the first collector 94 is formed with deformed portions 103 as shown in FIGS. 11 and 12 that permit the sections 96 and 97 to run in close parallel side-by-side fashion.

Figure 7:
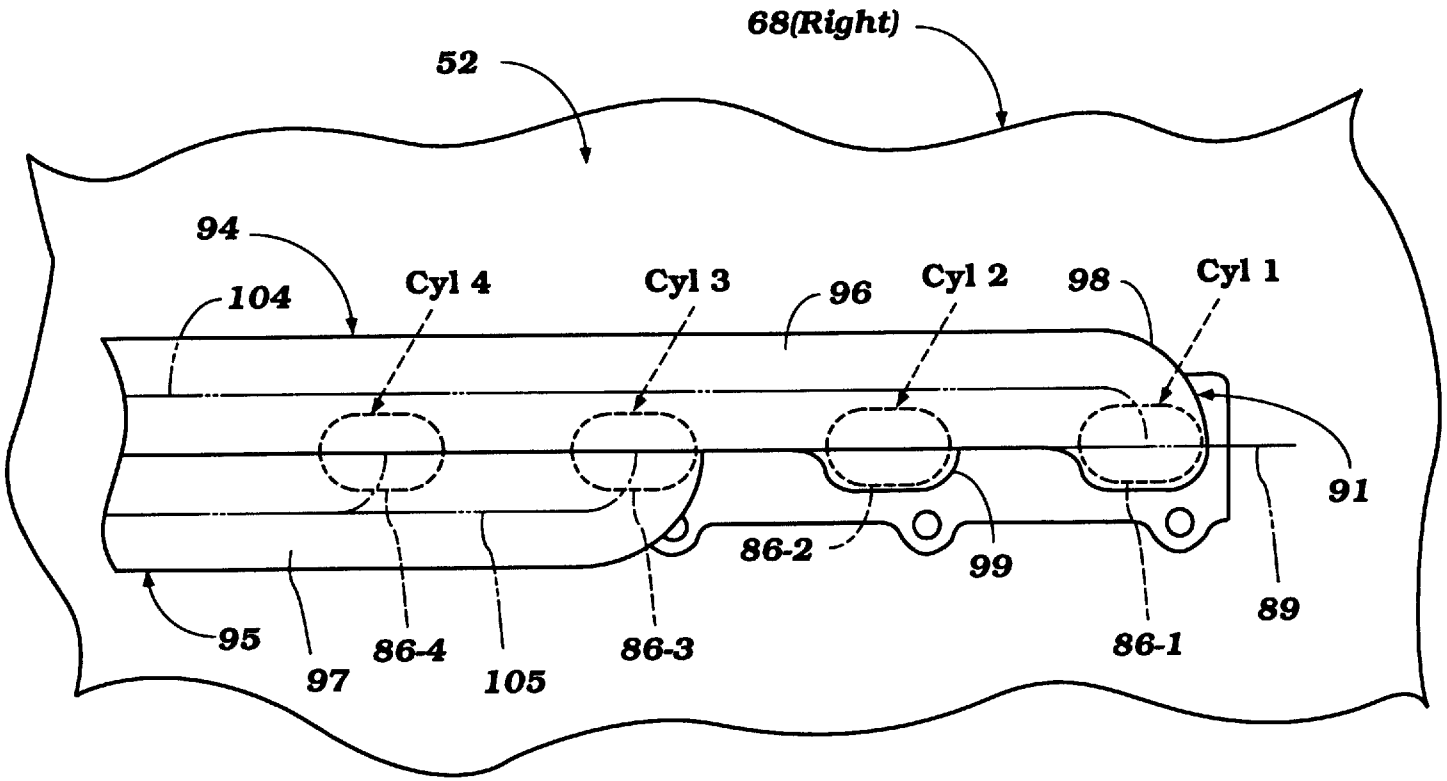
FIG. 7 is an enlarged side elevational view looking in the direction of the arrow 7 in FIG. 3 and shows the exhaust manifold associated with the right hand bank of cylinders.
Figure 8:
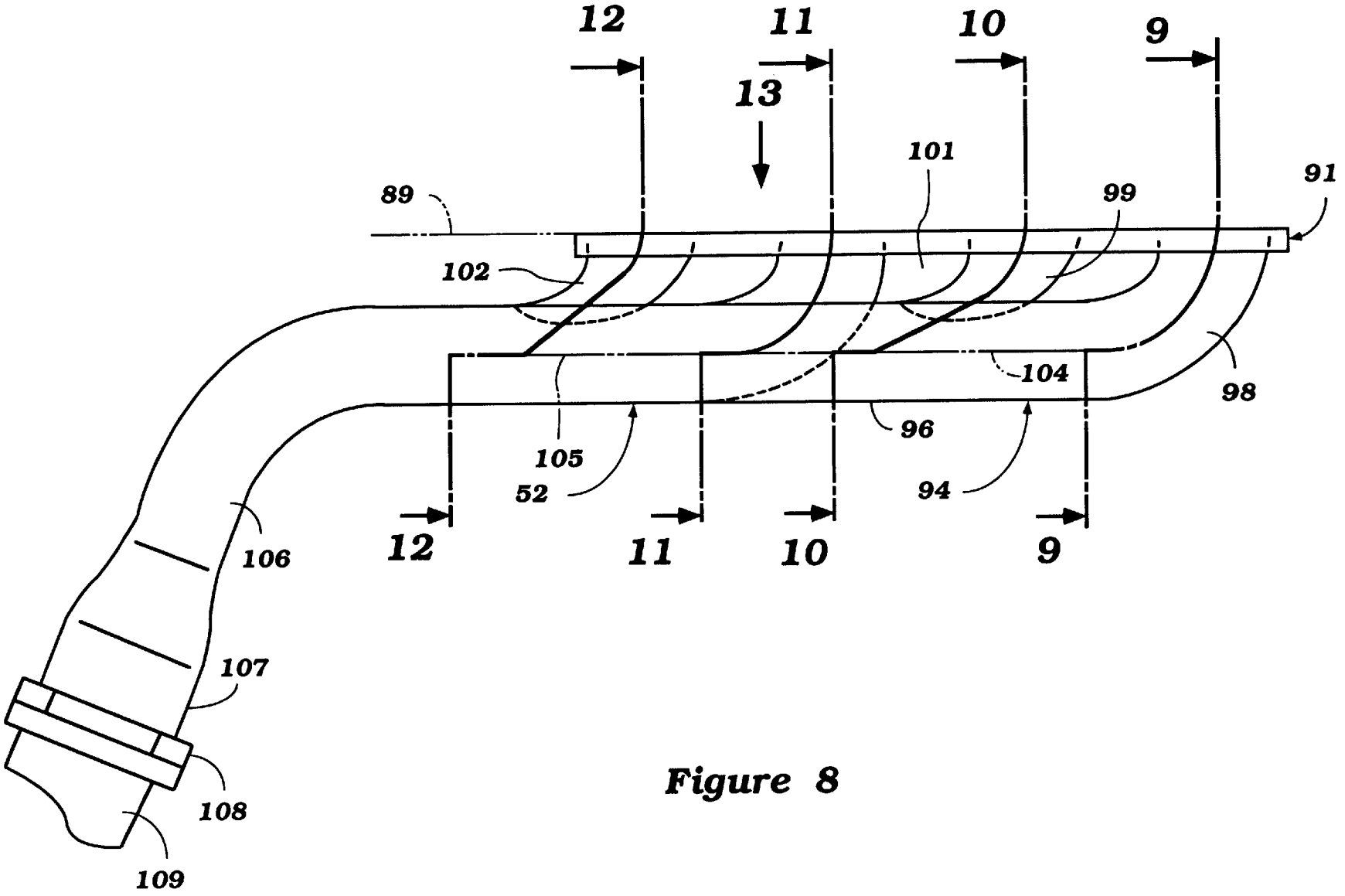
FIG. 8 is a top plan view of the right hand exhaust manifold.
Figure 9:
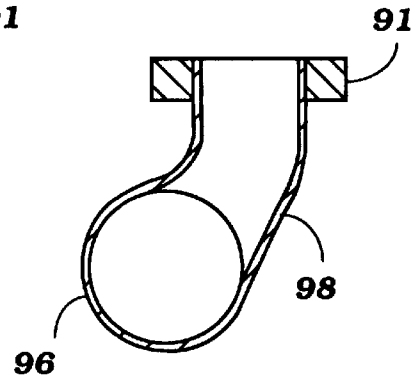
FIGS. 9, 10, 11 and 12 are cross-sectional views taken respectively along the lines 9—9, 10—10, 11—11 and 12—12 of FIG. 8.
Figure 10:
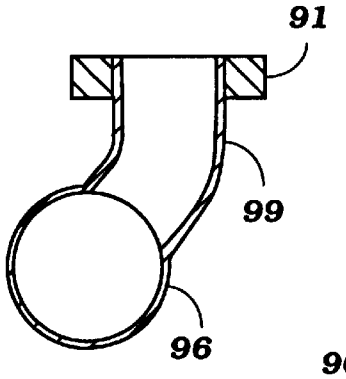

It should be noted that these sections have flow axes 104 and 105, respectively, that lie in a common vertical plane and which are disposed one over the other in a horizontal plane as shown in FIGS. 8 and 7, respectively. Each of the collector sections 94 and 95 curves outwardly and downwardly as shown at 106 to join a collecting portion 107 that has a flange 108 for connection to the exhaust 109 or other component of the exhaust system.

Although the exhaust manifold 52 is quite compact, it should be noted that the firing order of the cylinders is such that the exhaust pulses from one cylinder will not enter the respective collector section 94 or 95 at a close firing angle from the others so as to reduce interference between the respective cylinders. As may be seen in FIG. 6, the collector section 94 receives the exhaust gases from cylinder No. 1 and No. 2 and cylinder No. 2 does not fire until 270 degrees after cylinder No. 1 has fired. Therefore, there will be 270 degrees duration between firing of cylinder 2 from cylinder 1. In addition, cylinder 1 will not fire again until 450 degrees later so that there will be a substantial time interval between cylinder firings and a minimum interference between the exhaust pulses.

In a similar manner, the collector section 95 which collects the exhaust gases from cylinders 3 and 4 will experience a large gap between cylinder firings. Cylinder 4 does not fire until 450 degrees after cylinder 3. In addition, cylinder 3 does not fire again until 270 degrees after cylinder 4 has fired so there will be a large duration between firings of the cylinders that are served by the collector section 95. As a result, even though a very compact exhaust manifold is provided, there are substantial time intervals between the firings served by the collector sections.

A similar result is achieved by the left-hand exhaust manifold 53 as will now be apparent by reference to FIGS. 14–20 which show this manifold in greater detail. Again, the individual cylinders have been indicated by their respective cylinder numbers 5, 6, 7 and 8 with this suffix being applied to components such as the exhaust passages 87, etc.

Like the exhaust manifold 52, the exhaust manifold 53 is provided with a flange portion 111 which has individual openings 112-5, 112-6, 112-7 and 112-8 that are affixed in abutting relationship with the cylinder head surface 88 in mating relationship with the exhaust port openings 87-5, 87-6, 87-7 and 87-8. The flange 111 is provided with parallel openings 113 that receive threaded fasteners (not shown) so as to affix the exhaust manifold 153 to the cylinder head surface 88 in good sealing relationship.

Like the exhaust manifold 52, the exhaust manifold 53 is comprised of a pair of collector sections including a first collector section, indicated generally by the reference numeral 114 and a second collector section, indicated generally by the reference numeral 115. As with the exhaust port openings of the right-hand cylinder bank, the exhaust port openings 87 of the left-hand cylinder bank lie on a common axis, indicated by the broken line 120.

The first collector section 114 is provided with a generally straight section 116 which runs in generally parallel relationship to a straight section 117 of the second collector section 115. These collector sections have respective axes 118 and 119 which are parallel to the axis 116 and extend in side-by-side relationship. The axis 119 is parallel to the axis 116 and lies at the same vertical height as it.

The collector section 114 serves the cylinders 5 and 7 and to that end is provided with a first runner 121 which extends from the flange opening 112-5 to the straight common section 116 at an acute angle to provide large oval shaped flow connection. In a similar manner, a runner 122 extends from the flange opening 112-7 to the straight section 116 at an acute angle to provide large oval shaped flow connection.

In a similar manner, the straight section 117 of the collector portion 115 is served by a first runner 123 which extends from the flange opening 112-6 that cooperates with the second cylinder of this bank (cylinder No. 6). A second runner section 124 cooperates with the flange opening 112-8 and terminates at the straight section 117. Again these connections are oval shaped due to the acute angle between the branch runners and the straight section.

Figure 15:
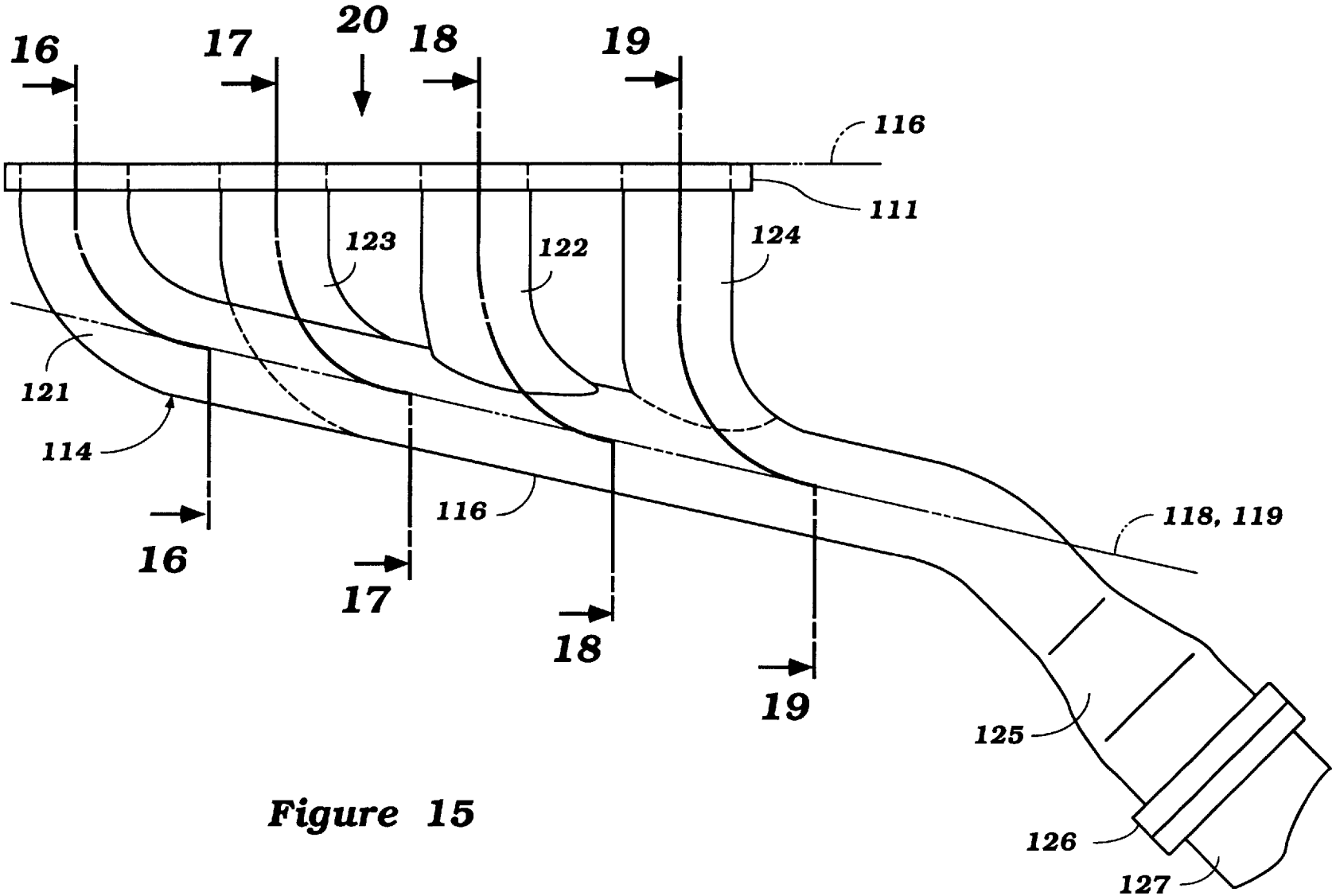
FIG. 15 is a top plan view of the left bank exhaust manifold.
Figures 16, 17, 18, 19:
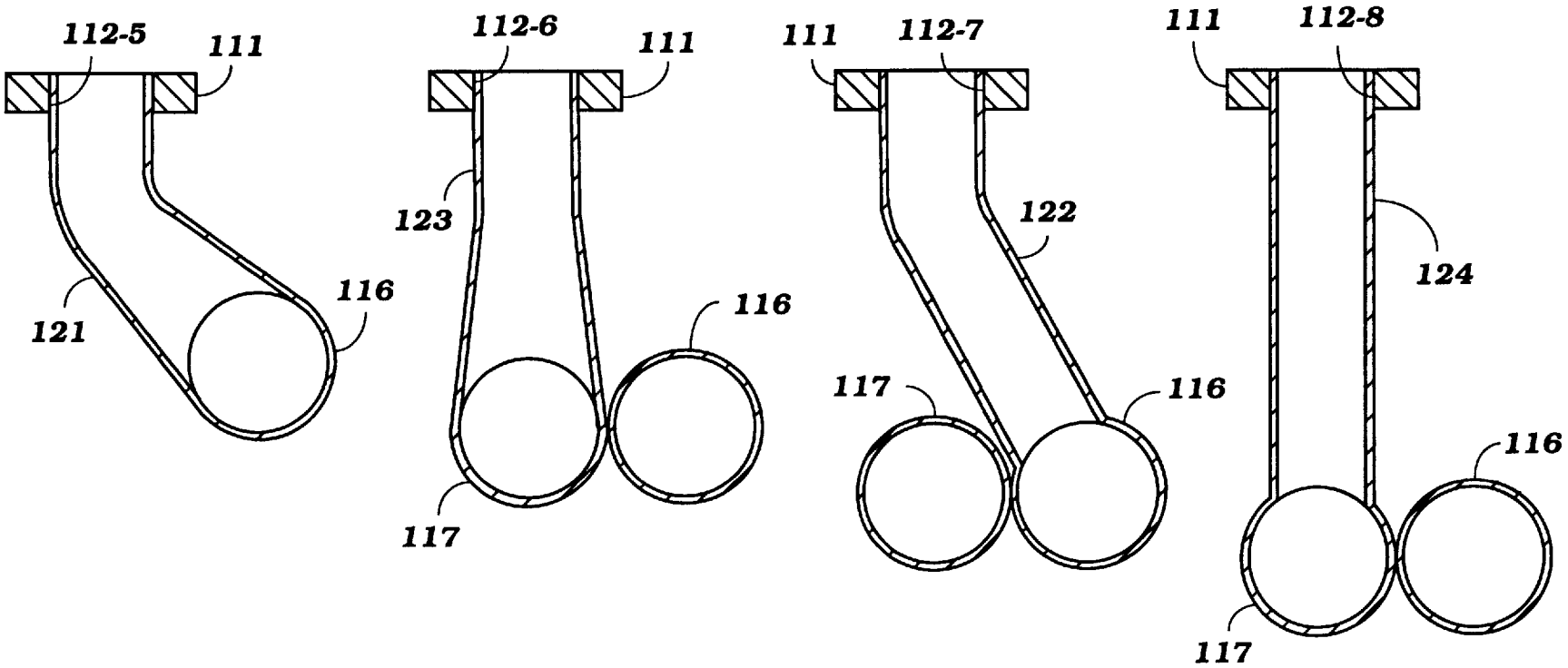
FIGS. 16, 17, 18 and 19 are cross sectional views taken along the lines 16—16, 17—17, 18—18 and 19—19, respectively, of FIG. 15.
Figure 20:
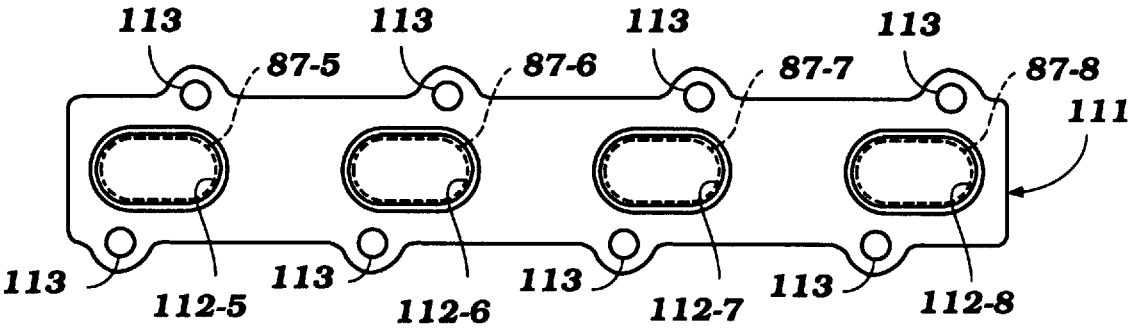
FIG. 20 is an elevational view of the flange of the left hand exhaust manifold looking in the direction of the arrow 20 in FIG. 15.

As may be clearly seen in FIGS. 14–19, the straight sections 116 and 117 extended in parallel side-by-side relationship in a common vertical claim which one being disposed horizontally above the other (116 over 117). Therefore, their axes 118 and 119 lie in a common plane but this plane is skewed slightly, as seen in FIG. 15, away from the cylinder block to provide clearance for a component such as a starter motor or other accessory driven from the engine.

The straight sections 116 and 117 merge into a collector part 125 which has a flange 126 for attachment to an exhaust pipe 127 or other component of the exhaust system.

Referring again to the firing order diagram of FIG. 6, it will be seen that the two joined cylinders, cylinder 5 and 7 of the collector section 114, fire 270 degrees from each other with cylinder No. 7 and cylinder No. 5 firing 270 degrees later. There is then an interval of 450 crank angle degrees before cylinder No. 7 fires after cylinder No. 5 has fired. In a similar manner, the collector section 115 receives first the firing of cylinder No. 6 and cylinder no. 8 does not fire until 270 degrees later. There then is an interval of 450 degrees of crankshaft rotation before cylinder No. 6 again fires.

In addition to the widely spaced firings of the individual collector sections of each exhaust manifold, it will also be noted that there is fairly substantial crank angle rotation before the next cylinder served by each collector section fires so that pulses back and forth from the collector sections also will be substantially minimized. In addition, each of the manifold 52 and 53 do not merge at their respective collector portions 107 and 125 so that the pulse effect will be substantially eliminated.

Of course, the foregoing description is that of a preferred embodiment of the invention and various changes and modifications may be made without departing from the spirit and scope of the invention, as defined by the appended claims.

I claim:

1. A V-type internal combustion engine having a pair of angularly inclined cylinder banks each containing four cylinders and forming four exhaust ports on oppositely facing external surfaces thereof, a pair of exhaust manifolds, each affixed to a respective one of said cylinder bank external surface, each exhaust manifold being comprised of an integral metallurgically attached unit comprised of at least two tubular collector sections, each collector section having a collector pipe section connected to at least two integral metallurgically attached branch sections, each of said branch sections being connected to a respective one of said exhaust ports, said collector sections extending at least in substantial part in parallel relationship to each other and a common collector metallurgically attached to the discharge ends of said collector sections and forming a single exhaust gas outlet; said branch sections serving said collector sections being associated with cylinders that do not fire more frequently than 270 degrees of crankshaft rotation from each other, said branch sections being disposed at an acute angle to the collector pipe sections.

2. An exhaust manifold as in claim 1, wherein the common collector has a flange portion for connection to a further component of the exhaust system.

3. An exhaust manifold as in claim 2, wherein the common collector exhaust gas outlet is disposed at a substantial distance from the branch sections.

4. An exhaust manifold as in claim 2, wherein portions of the collector section that extend in parallel relationship are disposed adjacent to each other in vertically spaced relationship.

5. A V-type internal combustion engine as set forth in claim 4, wherein the branch sections have generally tubular shape and merge into the collector sections in generally oval-shaped passages.

6. A V-type internal combustion engine as set forth in claim 5, wherein at least some of the branch sections associated with one of the collector sections are juxtaposed to adjacent collector sections and the adjacent collector sections are configured to nest around the branch sections.

* * * * *